US007458444B2

(12) United States Patent
Huang

(10) Patent No.: US 7,458,444 B2
(45) Date of Patent: Dec. 2, 2008

(54) BRAKING DEVICE FOR CYCLING EXERCISER

(76) Inventor: Ya Ling Huang, No. 64, Ousiang Shincheng, Sanyi Hsiang, Miaoli Hsien 36744 (TW)

( * ) Notice: Subject to any disclaimer, the term of this patent is extended or adjusted under 35 U.S.C. 154(b) by 492 days.

(21) Appl. No.: 11/264,841

(22) Filed: Nov. 1, 2005

(65) Prior Publication Data

US 2007/0099769 A1 May 3, 2007

(51) Int. Cl.
*F16D 55/08* (2006.01)

(52) U.S. Cl. ..... 188/72.1; 188/72.7; 482/65

(58) Field of Classification Search ..... 188/72.1, 188/72.7, 72.8; 482/57, 63, 65
See application file for complete search history.

(56) References Cited

U.S. PATENT DOCUMENTS 3,451,674 A * 6/1969 Lundgren et al. ..... 482/60
4,417,724 A * 11/1983 Bikker ..... 482/63
4,822,032 A 4/1989 Whitmore et al. ..... 272/73
6,273,845 B1 * 8/2001 Liou ..... 482/63
6,736,762 B2 5/2004 Chen ..... 482/63
7,011,607 B2 * 3/2006 Kolda et al. ..... 482/57

* cited by examiner

*Primary Examiner*—Pam Rodriguez
(74) *Attorney, Agent, or Firm*—Charles E. Baxley

(57) ABSTRACT

A rotational facility includes a barrel coupled to a driving device for being rotated and driven by the driving device, a wheel rotatably attached onto the barrel, and a braking device secured to the wheel for engaging with the barrel and for braking the wheel relative to the barrel. The braking device includes a housing secured to the wheel and one or more actuating members received in the housing for engaging with the barrel to brake the housing and the wheel relative to the barrel. The housing includes a brake member for engaging with and for actuating the actuating member to engage with the barrel. The housing includes a peripheral channel formed by inner and outer peripheral walls to receive the brake member.

8 Claims, 7 Drawing Sheets

BRAKING DEVICE FOR CYCLING EXERCISER

BACKGROUND OF THE INVENTION

1. Field of the Invention

The present invention relates to a resistive or braking device, and more particularly to a braking device for applying a resistive or braking force against a spindle of various rotational objects or facilities, such as unicycles, bicycles, tricycles, motorcycles, cycling exercisers or the like.

2. Description of the Prior Art

Typical rotational devices or facilities, such as unicycles, bicycles, tricycles, motorcycles, cycling exercisers or the like comprise a rotational spindle rotatably supported on a frame or support, and a foot actuating or hand driving mechanism coupled to the spindle for rotating or driving the spindle.

For increasing the momentum of the spindle, one or more wheels may further be provided and attached onto the spindle, for increasing the weight or the momentum of the spindle, and thus for applying an amount of resistive force against the foot actuating or hand driving mechanism, such that the user have to spend an increased force or energy to drive the rotational devices or facilities with the foot actuating or hand driving mechanism.

A braking or resistive device will further be provided and attached onto the frame or support, for further applying a resistive force or braking force against the wheels, in order to brake the wheels and the spindle. Normally, the braking device is provided and arranged to engage with or to act onto the outer peripheral portion of the wheel, in order to brake the wheels.

For example, U.S. Pat. No. 4,822,032 to Whitmore et al. discloses one of the typical exercise mechanisms including a source of magnetism or U-shaped magnet attached to and engaged with or acted onto the outer peripheral portion of a wheel, in order to brake the wheel.

U.S. Pat. No. 6,736,762 to Chen discloses another typical exercise mechanisms including a brake belt or cable attached to and engaged onto the outer peripheral portion of a wheel, in order to brake the wheel.

It is to be noted that the typical braking or resistive devices, such as the magnetic braking or resistive devices, the brake belts or cables, etc. are arranged and provided for engaging onto the outer peripheral portion of the wheel of the rotational devices or facilities, in order to brake the wheel, but may not be used to brake the spindle of the wheel; i.e., the typical braking or resistive devices may not be used or provided to brake the spindle of the wheel.

The present invention has arisen to mitigate and/or obviate the afore-described disadvantages of the conventional braking devices for rotational devices or facilities or exercisers.

SUMMARY OF THE INVENTION

The primary objective of the present invention is to provide a braking device for applying a resistive or braking force against a spindle of various rotational objects or facilities, such as unicycles, bicycles, tricycles, motorcycles, cycling exercisers or the like.

In accordance with one aspect of the invention, there is provided a rotational facility comprising a driving device, a barrel coupled to the driving device for being rotated and driven by the driving device, a wheel rotatably attached onto the barrel, and a braking device secured to the wheel, for engaging with the barrel and for braking the wheel relative to the barrel.

The wheel includes at least one unidirectional bearing engaged between the wheel and the barrel, to allow the wheel to be rotated relative to the barrel in one direction. The braking device includes a housing secured to the wheel and having a bore formed therein for rotatably attached onto the barrel, and at least one actuating member received in the housing and extended into the bore of the housing to engage with the barrel and to brake the housing and the wheel relative to the barrel.

The housing includes a brake member received therein for engaging with the actuating member and for actuating the actuating member to engage with the barrel. The housing includes a peripheral channel formed therein and defined by an inner peripheral wall and an outer peripheral wall for receiving the brake member therein.

The brake member includes a bore formed therein and defined by an inner peripheral surface for rotatably attached onto the inner peripheral wall of the housing, and includes at least one braking element extended into the bore thereof for engaging with and for actuating the actuating member to engage with the barrel.

The housing includes a spring member engaged with the brake member for biasing the braking element to actuate the actuating member to engage with the barrel. The housing includes an adjusting device for engaging with the spring member and for adjusting an engagement between the brake member and the actuating member and the barrel.

The adjusting device includes a fastener secured to the housing and engaged with the spring member for adjusting the spring member relative to the housing. The housing includes an anchor member disposed therein and engaged between the fastener and the spring member. The brake member includes an extension extended therefrom for engaging with the spring member. The housing includes a compartment formed therein for receiving the extension of the brake member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
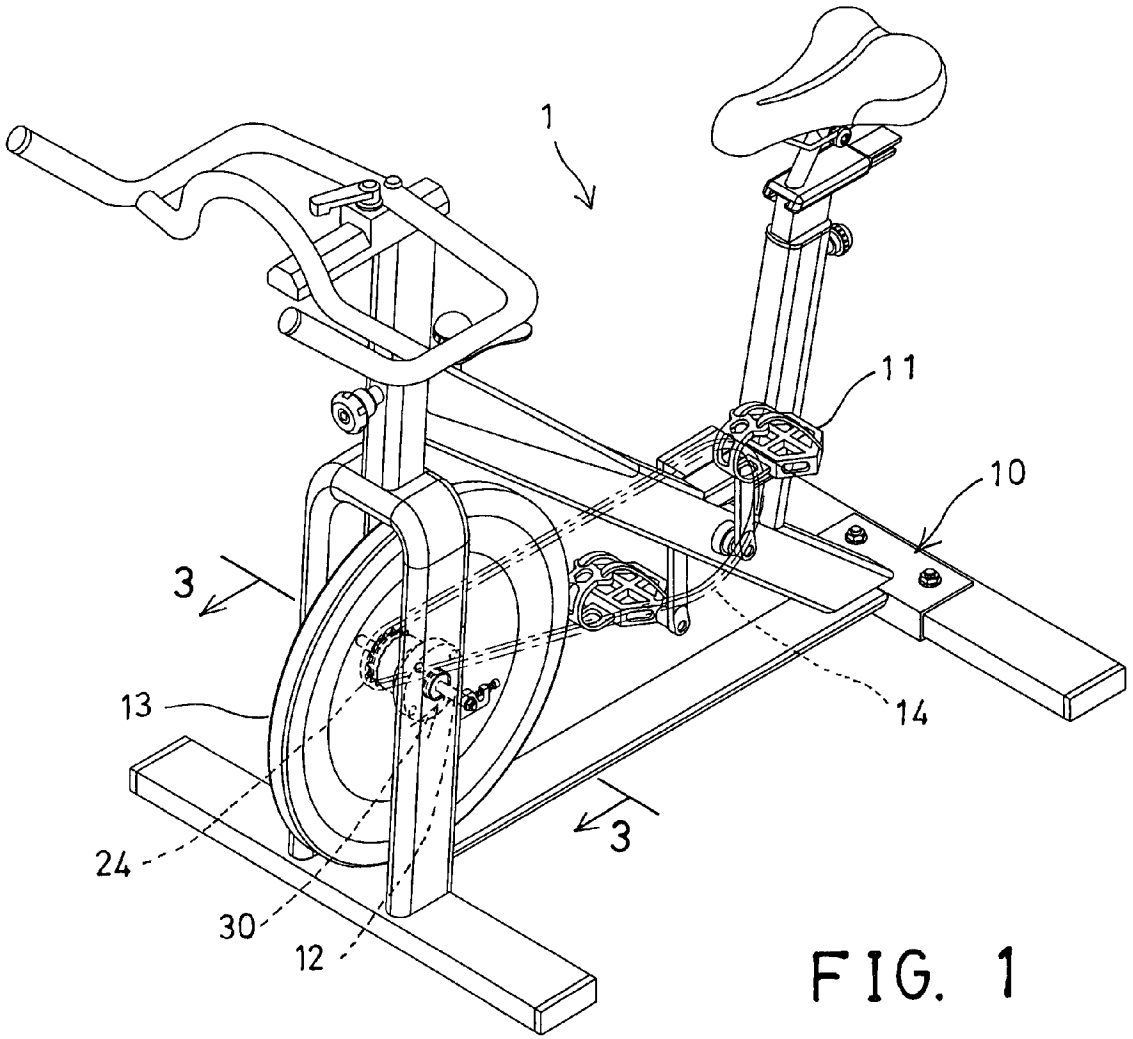
FIG. 1 is a perspective view of a rotational device or facility, such as a cycling exerciser having a braking device in accordance with the present invention.
Figure 2:
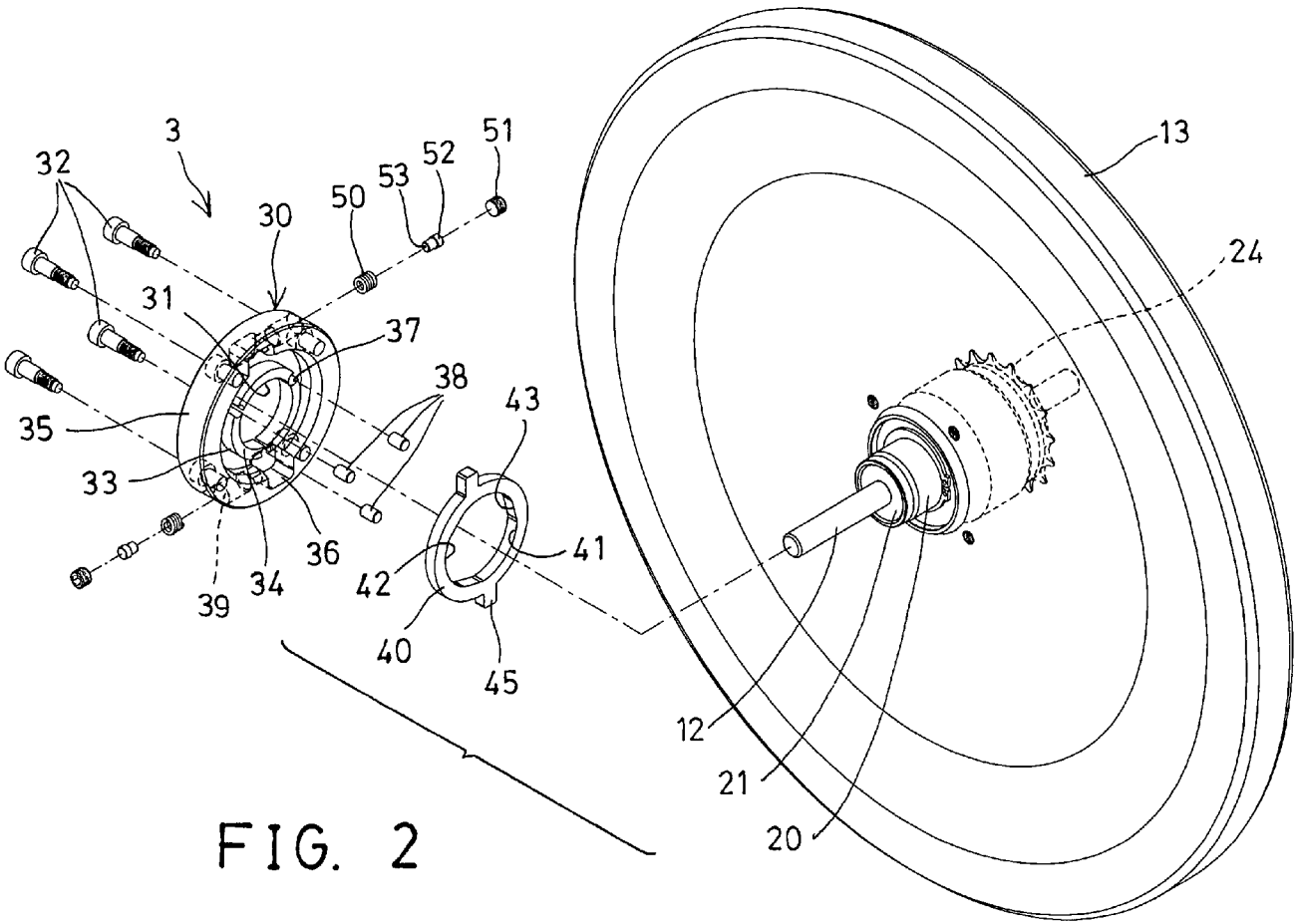
FIG. 2 is a partial exploded view of the braking device for the rotational facility.
Figure 3:
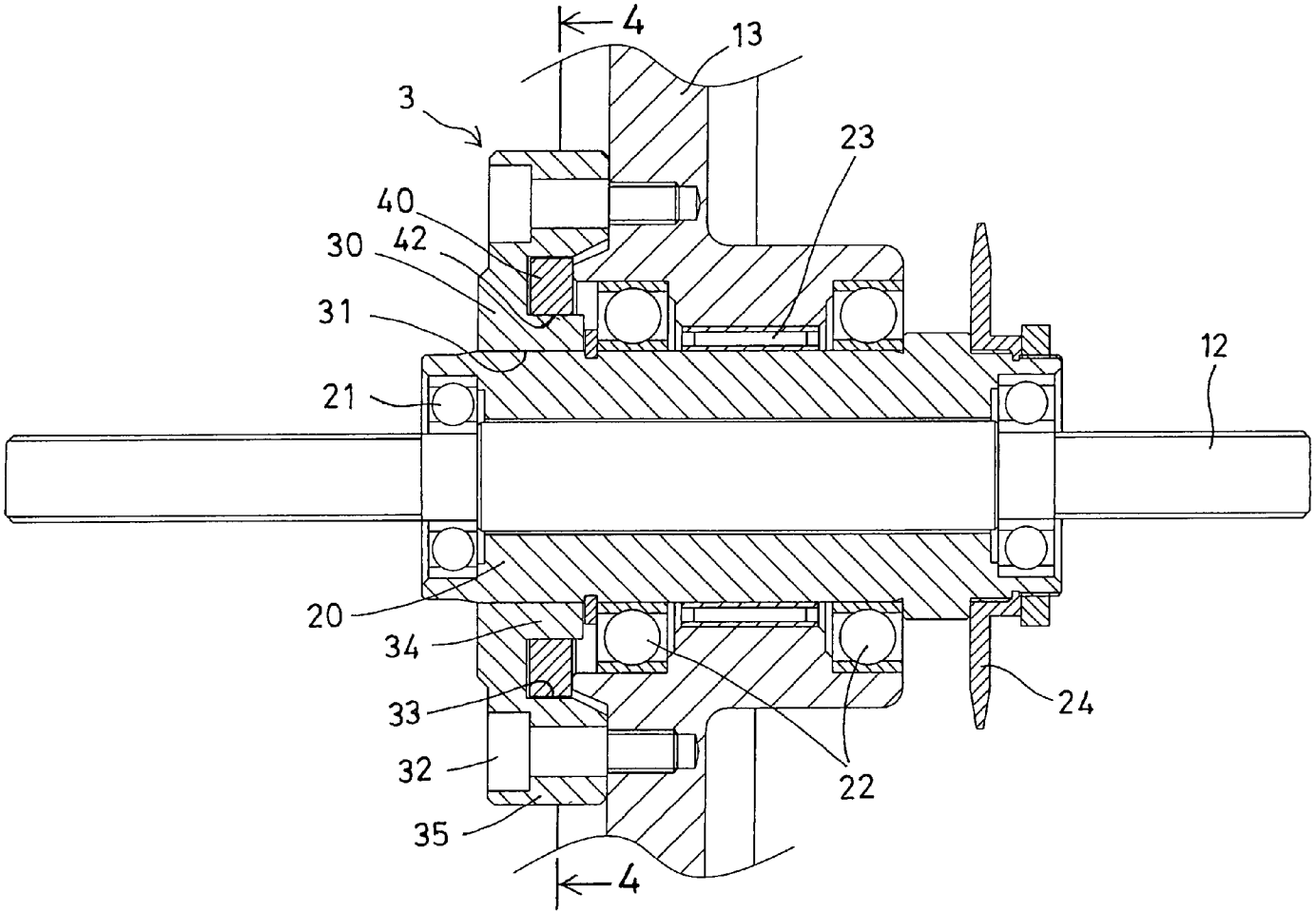
FIG. 3 is a partial cross sectional view of the braking device, taken along lines 3-3 of FIG. 1.

Referring to the drawings, and initially to FIG. 1, a rotational facility 1 in accordance with the present invention comprises a driving mechanism or device 11, such as a hand driving or foot actuating mechanism or device 11 or a pair of cranked foot pedals 11 rotatably attached to or supported on a base or support or frame 10, a spindle 12 (FIGS. 1-4) attached or supported on the frame 10 for rotatably supporting a wheel 13 thereon, and a coupling device 14, such as a pulley-and-belt coupling device 14, a gearing coupling device 14, a sprocket-and-chain coupling device 14, or the like for coupling the driving device 11 to the wheel 13, and for rotating or driving the wheel 13.

Normally, a barrel 20 is rotatably attached or engaged onto the spindle 12 with one or more bearings 21, to allow the barrel 20 to be freely rotatable relative to the spindle 12 or to be rotatably supported on the spindle 12. The wheel 13 is then rotatably attached or engaged onto the barrel 20 with one or more bearings 22 and one or more unidirectional bearings 23, to allow the wheel 13 to be rotated relative to the barrel 20 in one direction only. A coupling member 24, such as a pulley, a gearing, or a sprocket 24 is attached or secured onto the barrel 20 and rotated in concert with the barrel 20, and coupled to the coupling device 14, for allowing the barrel 20 and thus the wheel 13 to be rotated or driven by the driving device 11.

The rotational facility 1 in accordance with the present invention further includes a resistive or braking device 3 provided for applying a resistive or braking force against the barrel 20 or the wheel 13, or for braking the wheel 13 relative to the barrel 20. The braking device 3 includes a housing 30 having a bore 31 formed therein for rotatably attached or engaged onto the barrel 20 and secured to the wheel 13 with one or more fasteners 32, and includes a peripheral or circular channel 33 formed therein and defined by or between an inner peripheral wall 34 and an outer peripheral wall 35, and includes one or more, such as two compartments 36 formed therein, such as formed in the outer peripheral wall 35 thereof and communicating with the peripheral channel 33 thereof.

The housing 30 of the braking device 3 further includes one or more, such as three openings 37 formed therein, such as formed in the inner peripheral wall 34 thereof and opened toward and communicating with the peripheral channel 33 thereof, each for rotatably receiving a roller or actuating member 38 therein. The actuating members 38 include an outer diameter greater than the thickness of the inner peripheral wall 34 of the housing 30, for allowing the actuating members 38 to be slightly extended into the peripheral channel 33 of the housing 30. The openings 37 of the housing 30 are also communicating with the bore 31 of the housing 30, for allowing the actuating members 38 to be slightly extended into the bore 31 of the housing 30 and to engage with the barrel 20 and to brake the housing 30 and thus the wheel 13 relative to the barrel 20.

A peripheral or circular brake shoe or brake member 40 is rotatably or movably or loosely received within the peripheral channel 33 of the housing 30, and includes a bore 41 formed therein and defined by an inner peripheral surface 42 for rotatably attached or engaged onto the inner peripheral wall 34 of the housing 30, and includes one or more, such as three braking portions or braking elements 43, particularly the flattened braking elements 43 formed or provided therein and extended into the bore 41 thereof, for engaging with or for acting with the actuating members 38, best shown in FIGS. 4-7, and for forcing or actuating the actuating members 38 to engage with the barrel 20 and to brake the housing 30 and the wheel 13 relative to the barrel 20.

It is to be noted that the brake member 40 includes a thickness or width slightly smaller than the width of the peripheral channel 33 of the housing 30, to allow the brake member 40 to be loosely and is rotatably or movably received within the peripheral channel 33 of the housing 30. In addition, the distance between the inner peripheral surface 42 of the brake member 40 and the barrel 20 is no less than the outer diameter of the actuating members 38 to allow the actuating members 38 to be freely rotated relative to the barrel 20 and the wheel 13. However, the braking elements 43 are extended into the bore 41 thereof and thus may engage with or may force the actuating members 38 to engage with the barrel 20 and to brake the housing 30 and the wheel 13 relative to the barrel 20.

The brake member 40 further includes one or more, such as two ears or extensions 45 extended radially and outwardly therefrom and movably engaged into and confined within the compartments 36 of the housing 30 respectively, such that the rotational movement of the brake member 40 relative to the housing 30 is limited by the size or area or width of the compartments 36 of the housing 30. One or more, such as two spring biasing members 50 may further be provided and engaged into the compartments 36 of the housing 30 respectively, and engaged with the extensions 45 of the brake member 40 respectively, for biasing or forcing the brake member 40 to rotate relative to the housing 30, and thus for biasing or forcing the braking elements 43 to force and to actuate the actuating members 38 to engage with the barrel 20.

It is preferable that the housing 30 further includes one or more, such as two screw holes 39 formed therein, such as formed in the outer peripheral wall 35 thereof and communicating with the compartments 36 thereof for threading with adjusting devices 51, such as screws or bolts or fasteners 51, and for allowing the spring members 50 to be engaged into the compartments 36 of the housing 30 via the screw holes 39 of the housing 30 respectively before the adjusting devices or fasteners 51 are threaded to the housing 30. The spring members 50 may also be formed or taken as one part or element of the adjusting device 51.

Figure 4:
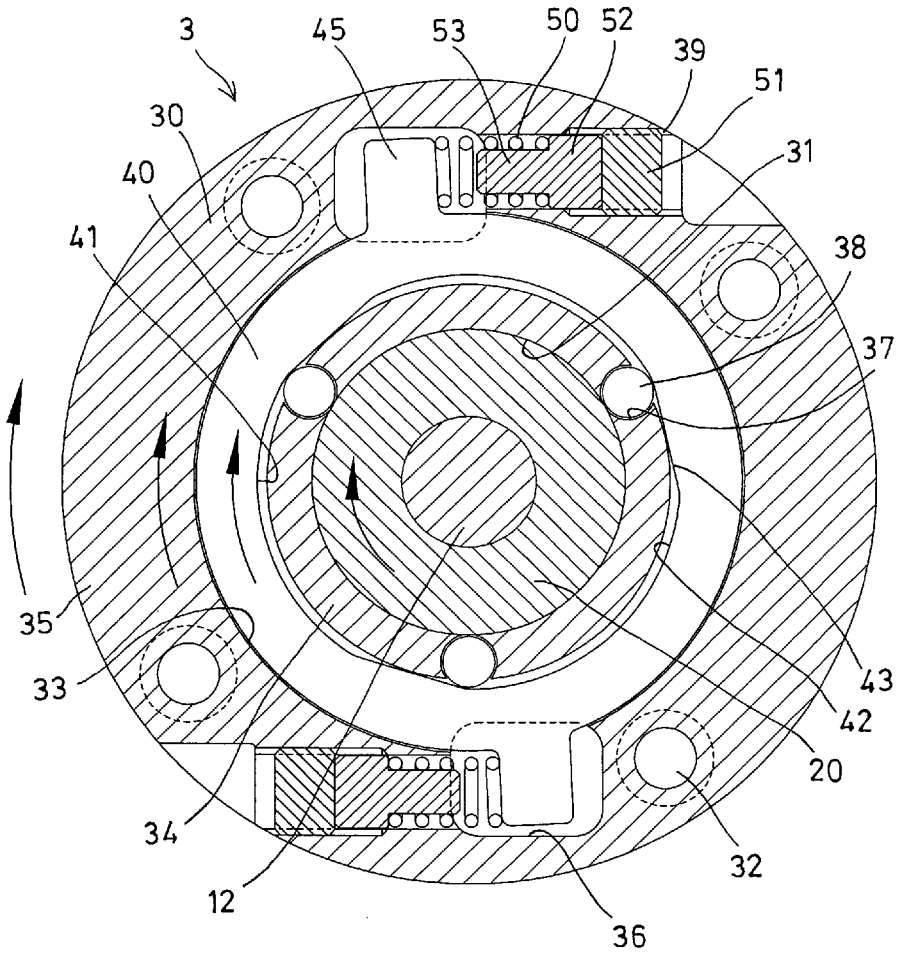
FIG. 4 is a partial cross sectional view of the braking device, taken along lines 4-4 of FIG. 3.

It is preferable that an anchor member 52 may further be provided and engaged into each of the compartments 36 or the screw holes 39 of the housing 30, and includes a finger or limb 53 extended therefrom, for engaged into or with the spring members 50, and for suitably positioning the spring members 50 to the housing 30 and to suitably engage with the extensions 45 of the brake member 40 respectively. In operation, as shown in FIG. 4, when the barrel 20 and thus the wheel 13 are rotated or driven by the driving device 11 via the coupling device 14, the housing 30 which is secured to the wheel 13 may also be rotated in concert with the barrel 20 and the wheel 13.

Figure 5:
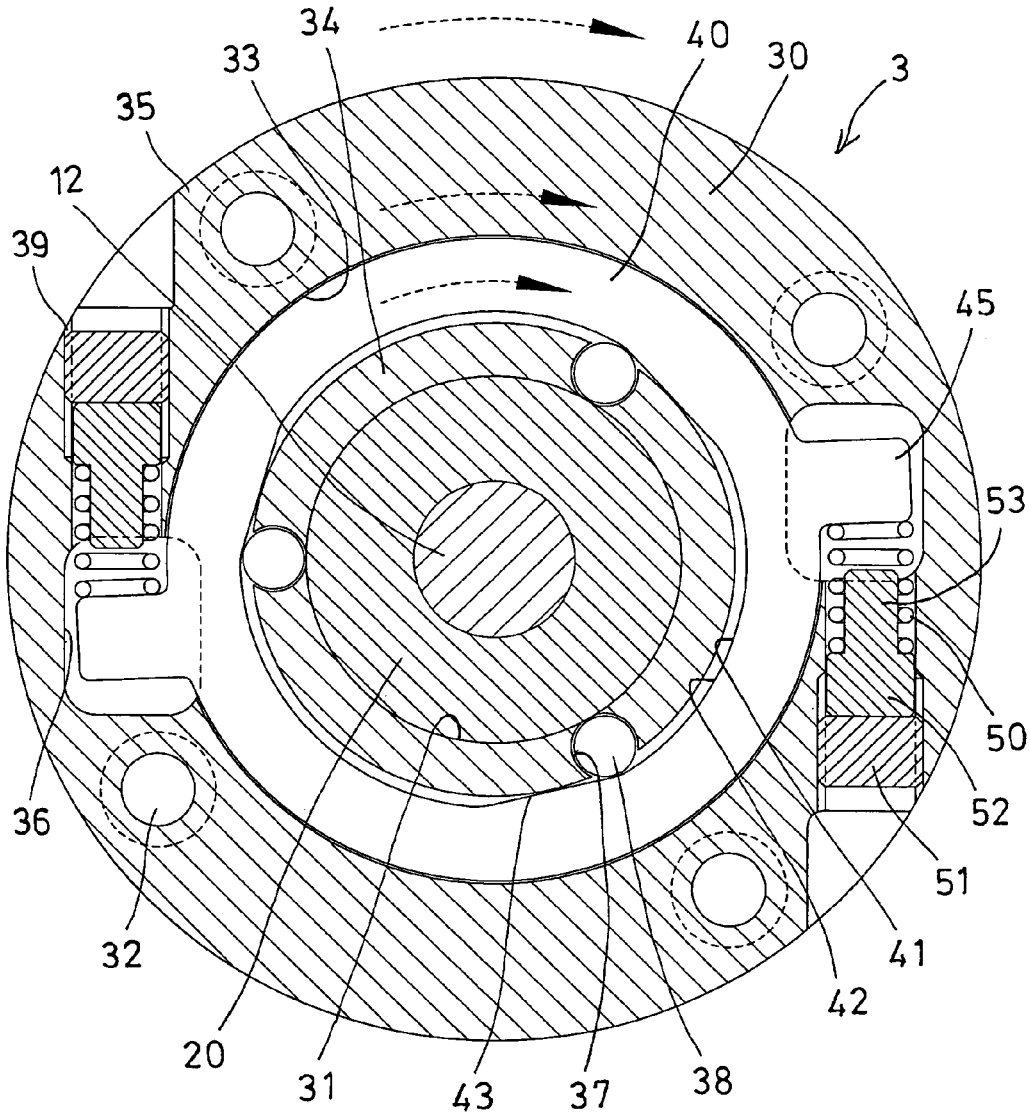
FIGS. 5, 6 are partial cross sectional views similar to FIG. 4, illustrating the operation of the braking device.

When the driving device 11 is stopped or when the user do not actuate or step onto the driving device 11, the barrel 20 will not be rotated or driven by the driving device 11 at this moment, the wheel 13 and thus the housing 30 may still be rotated relative to the spindle 12 due to the rotational momentum of the wheel 13 and the housing 30. At this moment, as shown in FIG. 5, the housing 30, particularly the inner peripheral wall 34 of the housing 30 may force the actuating members 38 to engage with the braking elements 43 of the brake member 40 which may then force or actuate the actuating members 38 to engage with the barrel 20 and thus to brake the housing 30 and the wheel 13 relative to the barrel 20.

Figure 6:
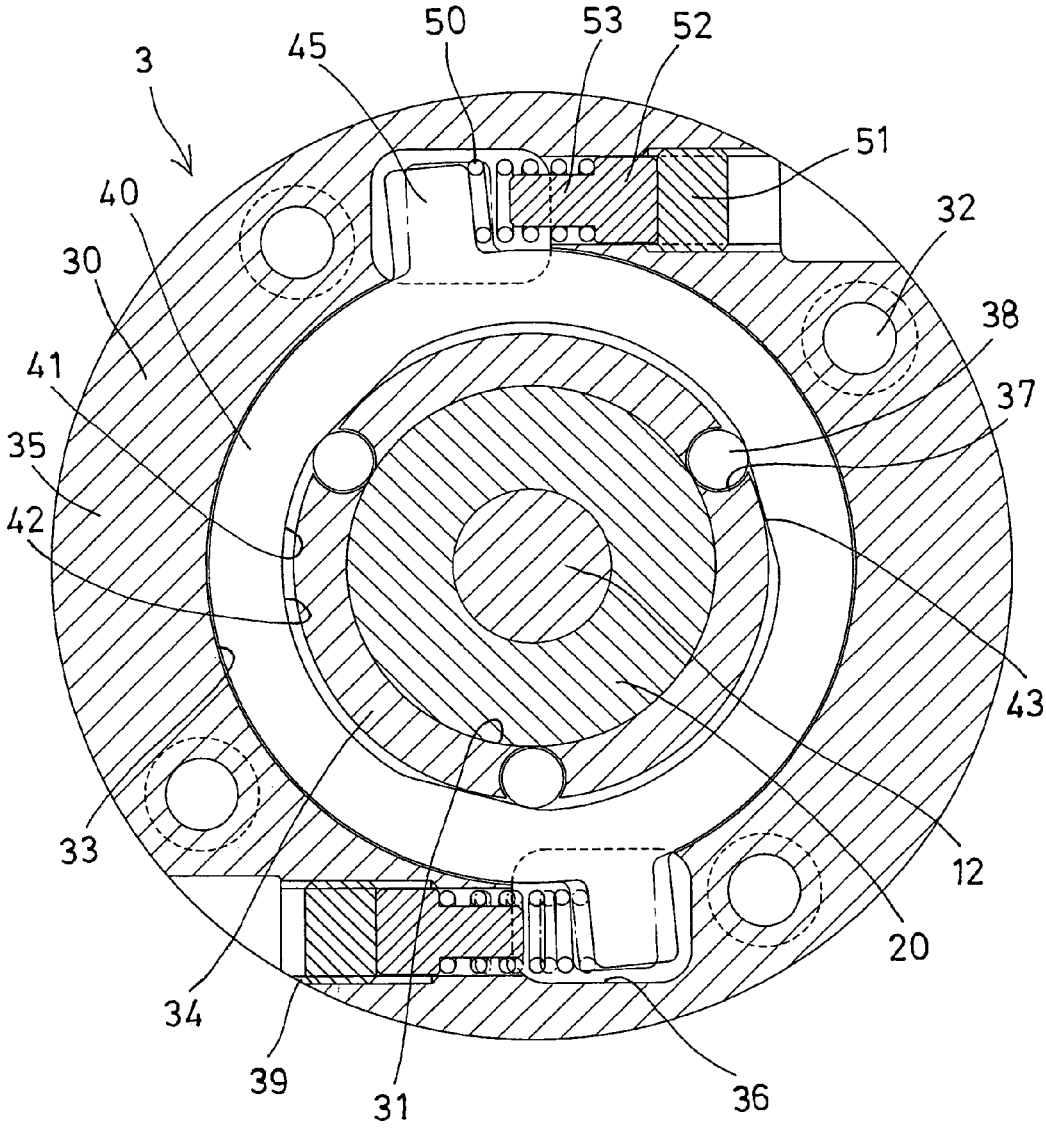
Figure 7:
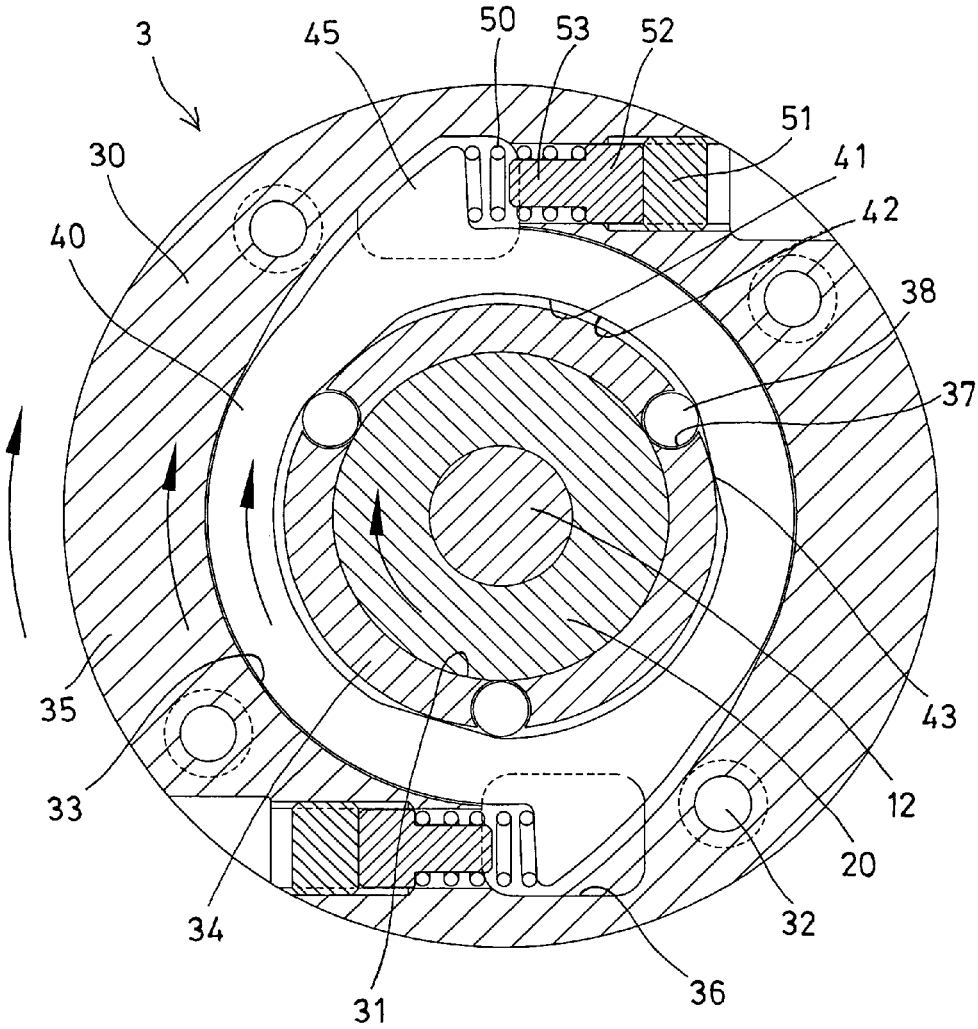
FIG. 7 is a partial cross sectional view similar to FIGS. 4-6, illustrating the other arrangement of the braking device.

As shown in FIG. 6, the adjusting devices or fasteners 51 may be threaded with and moved relative to the housing 30, to adjust the engagement between the actuating members 38 and the barrel 20 and the inner peripheral surface 42 of the brake member 40, and thus to adjust the resistive or braking force of the actuating members 38 against the barrel 20. As shown in FIG. 7, the compartments 36 of the housing 30 and the extensions 45 of the brake member 40 may be formed into various kinds of shapes or structures or configurations, but arranged to allow the spring members 50 to engage with the extensions 45 of the brake member 40 respectively.

It is to be noted that the resistive or braking device 3 may be provided or arranged for engaging with and for applying the resistive or braking force against the barrel 20 or the wheel 13, but not provided or engaging with and for braking the outer peripheral portion of the wheel 13, such that no resistive or braking devices will be provided or engaged with the outer peripheral portion of the wheel 13. For typical resistive or braking devices that are engaged with the outer peripheral portion of the wheel 13, a serious danger or disaster may occur when an object is engaged into or between the outer peripheral portion of the wheel 13 and the typical resistive or braking devices inadvertently.

Accordingly, the braking device in accordance with the present invention may be provided or used for applying a resistive or braking force against a rotational spindle of various objects or facilities, such as unicycles, bicycles, tricycles, motorcycles, cycling exercisers or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotational facility comprising:

a driving device, a barrel coupled to said driving device for being rotated and driven by said driving device, a wheel rotatably attached onto said barrel, and a braking device secured to said wheel for engaging with said barrel and for braking said wheel relative to said barrel, said braking device including a housing secured to said wheel and having a bore formed therein for rotatably attaching onto said barrel, and including at least one actuating member received in said housing and extended into said bore of said housing to engage with said barrel and to brake said housing and said wheel relative to said barrel, said housing including a brake member received therein for engaging with said at least one actuating member and for actuating said at least one actuating member to engage with said barrel, and said housing including a peripheral channel formed therein and defined by an inner peripheral wall and an outer peripheral wall for receiving said brake member therein, and said brake member including a bore formed therein and defined by an inner peripheral surface for rotatably attaching onto said inner peripheral wall of said housing, and including at least one braking element extended into said bore thereof for engaging with and for actuating said at least one actuating member to engage with said barrel.

2. The rotational facility as claimed in claim 1, wherein said wheel includes at least one unidirectional bearing engaged between said wheel and said barrel to allow said wheel to be rotated relative to said barrel in one direction.

3. The rotational facility as claimed in claim 1, wherein said housing includes a spring member engaged with said brake member for biasing said at least one braking element to actuate said at least one actuating member to engage with said barrel.

4. The rotational facility as claimed in claim 3, wherein said housing includes an adjusting device for engaging with said spring member and for adjusting an engagement between said brake member and said at least one actuating member and said barrel.

5. The rotational facility as claimed in claim 4, wherein said adjusting device includes a fastener secured to said housing and engaged with said spring member for adjusting said spring member relative to said housing.

6. The rotational facility as claimed in claim 5, wherein said housing includes an anchor member disposed therein and engaged between said fastener and said spring member.

7. The rotational facility as claimed in claim 3, wherein said brake member includes an extension extended therefrom for engaging with said spring member.

8. The rotational facility as claimed in claim 7, wherein said housing includes a compartment formed therein for receiving said extension of said brake member.

* * * * *